United States Patent [19]

Vydrzal et al.

[11] Patent Number: 4,883,228

[45] Date of Patent: Nov. 28, 1989

[54] WATER-STABILIZED SPRINKLER

[76] Inventors: William J. Vydrzal; William S. Vydrzal, both of 1409 E. 8th St., Smithville, Tex. 78957

[21] Appl. No.: 242,867

[22] Filed: Sep. 12, 1988

[51] Int. Cl.[4] ..... B05B 15/00

[52] U.S. Cl. ..... 239/279

[58] Field of Search ..... 239/251, 273, 275, 279, 239/513, 514, 518–524

[56] References Cited

U.S. PATENT DOCUMENTS

| | | | |
|---|---|---|---|
| D. 42,401 | 9/1945 | Goggins . | |
| D. 263,868 | 4/1982 | Chow . | |
| 1,577,225 | 3/1926 | Granger | 239/279 |
| 2,731,296 | 1/1956 | Griffith | 239/279 |
| 2,935,266 | 5/1960 | Coleondro et al. | 239/513 |
| 4,519,544 | 5/1985 | Szabo | 239/279 |

FOREIGN PATENT DOCUMENTS

| | | | |
|---|---|---|---|
| 2105615 | 3/1983 | United Kingdom | 239/279 |

*Primary Examiner*—Andres Kashnikow
*Assistant Examiner*—Karen B. Merritt

[57] ABSTRACT

A lawn-garden sprinkler wherein the sprinkler base is a hollow structure designed to receive water from the water supply hose, to thereby increase the weight of the base for improved resistance to overturnment by water pressure forces. The sprinkler can be used on flat ground and/or on sloping terrain (side hill positionment).

1 Claim, 1 Drawing Sheet

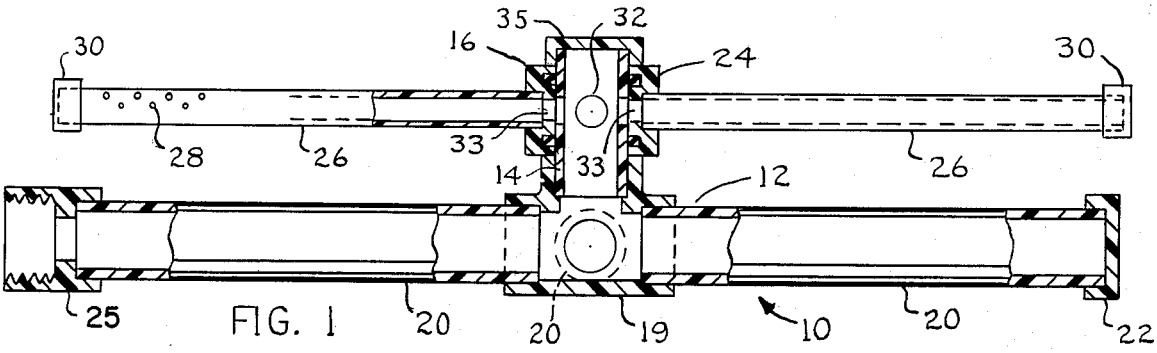
FIG. 1
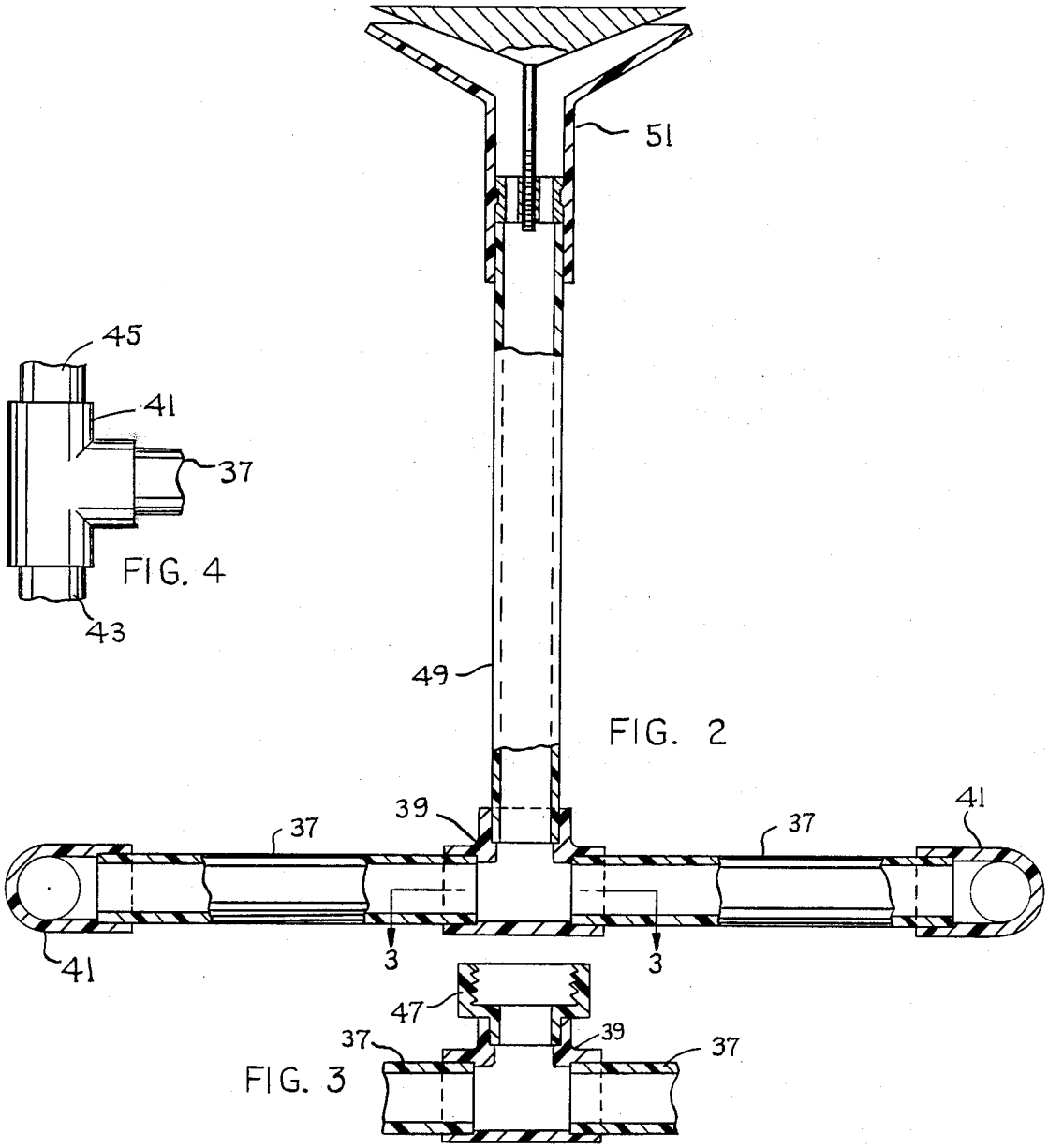
FIG. 4
FIG. 2
FIG. 3

WATER-STABILIZED SPRINKLER

BACKGROUND OF THE INVENTION

Our invention relates to lawn-garden sprinklers, of the type shown for example in U.S. Design Pat. Des. No 263,868 to Ho Chow, or U.S. Design Patent Des. No. 142,401 to J. Goggins.

A particular aim of our invention is to provide a sprinkler than is stable on the ground surface, especially when it is connected to a pressurized water source.

SUMMARY OF THE INVENTION

Our invention relates to a lawn garden sprinkler having a hollow base for containment of water therein. The weight of the water adds to the weight of the base, whereby the base seats firmly on the ground surface.

A major object of the invention is to provide a sprinkler that will not overturn or move when it is connected to a garden hose and a pressurized water source. The invention overcomes an "overturnment" problem present with some sprinklers, wherein the incoming water pressure generates a lateral force on the sprinkler base that can cause the sprinkler to shift, or wobble, or overturn (worst case scenario).

THE DRAWINGS

FIG. 1 is a section view through a sprinkler embodying our invention.

FIG. 2 is a sectional view through another sprinkler embodying the invention.

FIG. 3 is a fragmentary sectional view taken on line 3—3 in FIG. 2.

FIG. 4 is a fragmentary top plan view of a structural detail used in the FIG. 2 sprinkler.

DESCRIPTION OF A PREFERRED EMBODIMENT OF THE INVENTION

FIG. 1 illustrates one form that the invention can take. It shows a lawn-garden sprinkler 10 comprising a ground-engageable base 12, a short water conduct 14 extending upwardly from a central point on the base, and a sprinkler head 16 mounted on conduit 14 for spraying water into the surrounding atmosphere.

Base 12 comprises a central hub 19, and four equal length pipes 20 extending outwardly therefrom in a cross configuration (viewed in the plan direction). FIG. 1 shows two of the pipes in full lines and a third pipe in dashed lines; the fourth pipe would extend out of the plane of the paper in FIG. 1.

Three of the four pipes 20 have sealing caps 22 on their outer ends. The fourth pipe has an internally threaded water intake fitting 24 on its outer end. When a water supply hose (not shown) is screwed onto fitting 25 and supplied with pressurized water, all four pipes 20 fill with water to effectively increase the pressure exerted by base 12 on the ground surface.

Sprinkler head 16 comprises a rotary sleeve 24 having two or more hollow arms 26 extending radially outwardly above base 10. Each arm 26 has one or more nozzle openings 28 near its outer end. A sealing cap 30 is telescoped onto the outer end of each hollow arm 26.

Upstanding conduit 14 has a number of radial openings 32 therein that communicate with an annular groove 33 in sleeve 24 to supply pressurized water to hollow arms 26. Reaction forces at nozzle openings 28 cause the sprinkler head to rotate around the axis of conduit 14. A cap 35 on the upper end of the conduit retains the sprinkler head against axial dislodgement.

A primary feature of the FIG. 1 sprinkler is the construction of base 10, whereby water is maintained therein to augment the weight of the base, to thereby stabilize the base against shifting, wobble or overturnment. Conventional sprinklers are usually comparatively light, for example less than eight ounces. With our invention the effective weight of the sprinkler assembly can be appreciably increased, e.g. to about two pounds.

With an internal pipe diameter of one inch, each linear inch of pipe can contain above 0.03 pounds of water. A total pipe length of fifty inches would have a volume of about forty cubic inches; it would contain about one and one half pounds water. Assuming an empty sprinkler weight of about one half pound, we could then increase the effective sprinkler weight to about two pounds. We contemplate a construction wherein each of the four pipes 20 has a length on the order of twelve inches, to give a total pipe length of forty eight inches. If the pipe diameter were increased, e.g. to about one and one half inch, the individual lengths of pipes 20 could be decreased somewhat, although a long pipe length is desirable in that gives the base a "wide stance" positionment that aids the base weight in its anti-overturnment action.

FIG. 1 shows the sprinkler components formed of rigid plastic. Other materials can be used, although rigid plastic is preferred because of its rust-free property.

FIG. 2 shows another form that the invention can take. In this case the base is H-shaped in plan outline. The pipe assembly used to form the base comprises two pipes 37 extending in opposite directions from a central hub 39. In plan cross section (FIG. 3) hub 39 has three socket openings oriented in a horizontal T-configuration. Two of these socket openings are in horizontal axial alignment to form connections for the two horizontally aligned pipes 37; the third socket opening is normal to the first two socket openings for receiving a water intake fitting 47. The outer ends of pipes 37 fit into socket openings in T-fittings 41. Transverse pipes 43 and 45 (FIG. 4) extend into other socket openings in each T-fitting 41. FIG. 4 shows the T-fitting for one of the pipes 37. The T-fitting for the other pipe 37 would be similarly constructed.

Each of the four transverse pipes 43, 43, 45, 45 has a sealing cap at its outer (free) end, similar to cap 22 shown in FIG. 1. The assembly of pipes (37, 37, 43, 43, 45, 45) cooperates with central hub 39 to form an H-shaped base. The interior spaces within the various pipes are in fluid communication with the central space within hub 39.

Water is introduced into the sprinkler base through a threaded intake fitting 47 that is mounted directly on central hub 39 (FIG. 3). In an alternate arrangement, the intake fitting could be installed on the outer end of one of the four pipes 43, 43, 45, 45, in a fashion similar to that shown in FIG. 1 (per fitting 24).

The FIG. 2 sprinkler includes an upstanding conduit 49 having a conventional sprinkler head 51 mounted on its upper end for spraying water into the surrounding atmosphere. The lower end of conduit 49 is seated in a fourth vertical socket in central hub 39. The FIG. 2 sprinkler is a so-called "high rise" structure useful where it is desired to have the sprinkler head raised from the ground surface, e.g. to spray water onto plants. In the illustrated construction the "riser" conduit 49 is slightly longer than each pipe 37, although conduit 49 could be longer where necessary to clear the plant foliage.

The FIG. 2 structure offers the same primary advantage as the FIG. 1 structure, i.e. a heavy water-filled hollow base that prevents the sprinkler from tilting, wobbling or overturning when supplied with pressurized water.

The drawings show two forms that the invention can take. Other forms are possible.

We claim:

1. A garden sprinkler comprising a ground-engageable hollow base having an H-configuration in top plan view, an elongated riser conduit (49) extending upwardly from a central point on said base, and a sprinkler head (51) mounted on the upper end of said conduit; p1 said hollow base comprising a central hub member (39) having first, second, third and fourth socket openings therein; said first, second and third socket openings being oriented in a horizontal T-configuration, with said first and second socket openings being in horizontal axial alignment with one another, and with said third socket opening being normal to the first and second socket openings; said fourth socket opening extending vertically upwardly from a central point on the hub member;

an internally threaded water intake fitting (47) extending into said third socket opening, said intake fitting being adapted to connect with a water supply hose for introducing pressurized water into the central hub member and associated socket openings;

a first straight horizontal pipe (37) having one end thereof extending into said first socket opening; a second straight horizontal pipe (37) having one end thereof extending into said second socket opening, whereby said first and second pipes are in axial alignment with each other;

a first T-fitting (41) connected to the other end of said first pipe; third and fourth horizontal pipes (43 and 45) having ends thereof connected to said first T-fitting so that said third and fourth pipes are in axial alignment with each other and normal to said first pipe;

a second T-fitting (41) connected to the other end of said second pipe; fifth and sixth horizontal pipes having ends thereof connected to said second T-fitting so that said fifth and sixth pipes are in axial alignment with each other and normal to said second pipe;

sealing caps on the free ends of said third, fourth, fifth and sixth pipes;

said first, second, third, fourth, fifth and sixth pipes being in liquid communication with each other and with said central hub member, so that the weight of the hollow base is augmented by the weight of the water contained in said pipes, to thus provide increased resistance against overturnment of the sprinkler;

the aforementioned riser conduit having its lower end seated in said fourth socket opening so that pressurized water flows from the central hub member into the riser conduit and thence into the aforementioned sprinkler head;

said first and second horizontal pipes having the same length;

said third, fourth, fifth and sixth pipes having the same length, whereby the central hub member is located at the imaginary center of the hollow H-configuration base.

* * * * *